United States Patent [19]

Kanda et al.

[11] Patent Number: 4,530,312

[45] Date of Patent: Jul. 23, 1985

[54] PISTON WITH CROWN COOLING CAVITY AND RADIAL RIBS FORMED THEREIN

[75] Inventors: Mutsumi Kanda; Souichi Matsushita; Kiyoshi Nakanishi, all of Toyota, Japan

[73] Assignee: Toyota Jidosha Kabushiki Kaisha, Toyota, Japan

[21] Appl. No.: 623,934

[22] Filed: Jun. 25, 1984

[30] Foreign Application Priority Data

Mar. 14, 1984 [JP] Japan ..... 59-048824

[51] Int. Cl.[3] ..... F01P 3/10

[52] U.S. Cl. ..... 123/41.35; 92/186; 123/193 P

[58] Field of Search ..... 123/41.35, 41.39, 193 P; 92/158, 159, 186, 208, 216

[56] References Cited

U.S. PATENT DOCUMENTS 4,180,027 12/1979 Taylor ..... 123/41.35

4,331,107 5/1982 Bruni ..... 123/41.35

FOREIGN PATENT DOCUMENTS 617224 2/1949 United Kingdom ..... 92/159

*Primary Examiner*—William A. Cuchlinski, Jr.

*Attorney, Agent, or Firm*—Kenyon & Kenyon

[57] ABSTRACT

A piston for an internal combustion engine formed as an integrally cast article having a crown portion and a hollow cylindrical side wall portion, wherein the crown portion is formed with a transverse hollow space, radially outside portions of which are axially traversed by integrally formed ribs, the hollow space being adapted to be circulated by lubricant for the purpose of cooling the crown portion. To supply lubricant into and to drain lubricant from the hollow space, a transverse wall portion formed in the crown portion on the inner side of the hollow space is formed with a lubricant inlet opening and at least one lubricant outlet opening, preferably at portions located between the ribs.

8 Claims, 7 Drawing Figures

PISTON WITH CROWN COOLING CAVITY AND RADIAL RIBS FORMED THEREIN

BACKGROUND OF THE INVENTION

The present invention relates to a piston for an internal combustion engine, and, more particularly, relates to a piston for an internal combustion engine which incorporates a lubricant supply cooling system for cooling the piston during operation of the engine.

A piston for an internal combustion engine generally becomes very hot during use, and is subjected to relatively severe thermal stresses as compared to other engine parts, especially on its top wall or crown portion which is directly exposed to the heat of the gases in the combustion chamber partly defined by the piston. This problem of heating of the crown of the piston has become more and more severe with modern internal combustion engines, due to increases in thermal load on the parts thereof arising from increases in engine power output. Various schemes have been developed in the past for aiding with the cooling of such a piston; and nowadays some form of active cooling for the piston is coming to be quite necessary. In particular, the concept of cooling the piston crown from below by injecting a flow of engine lubricant from the crank chamber side up into the cup shaped space defined by the piston crown and the piston skirt, so as to impinge against the lower side of the piston crown and to cool it, has been put forward in the past in various forms.

In its simplest form, such a piston cooling system does not require any special modification to the piston structure, but, in order to further improve the effectiveness of cooling of the piston crown portion, there have been published various other proposals, in which a cavity is formed in the piston crown portion, or a lubricant receiving member is mounted in the cup shaped space defined by the piston skirt and crown portion. In these constructions, the lubricant injected towards the piston crown is temporarily received into some reservoir defined in the neighborhood of the lower side of said piston crown, so as to be splashed up thereagainst as the piston passes over its top dead center and starts to be accelerated downwards in the cylinder bore. For example, such piston cooling constructions have been proposed in Japanese Utility Model Applications Nos. 49-96796 and 55-42967, which have been respectively published as Japanese Utility Model Laying Open Publications Nos. 54-26424 and 57-156052, in Japanese Patent Application No. 58-138183, and in Japanese Utility Model Applications Nos. 58-164040 and 58-188456.

However, such prior art type of constructions have not been entirely adequate for requirements, because, firstly, it is undesirable to form the piston as an assembly with a lubricant receiving member mounted therein, due to considerations of durability and vibration, and, secondly, the provision of a large cavity in the piston crown portion has tended to weaken the piston, and to subject its outer peripheral portions to higher thermal stressing, due to the restricted path available for thermal conduction from the upper surface of the piston crown portion to the skirt portion and the piston pin boss portions of the piston. In particular, the piston rings likewise tend to be subjected to undue thermal stress, and their durability is undesirably deteriorated. Yet, it is not practicable to provide any moving parts to the piston, and the construction is absolutely required to be simple and strong and reliable, in view of the vibration and accelerative forces to which it is subject during operation of the engine.

SUMMARY OF THE INVENTION

Accordingly, it is the primary object of the present invention to provide a piston, which can be well and effectively cooled by lubricant supply to an internal space defined within its crown portion.

It is a further object of the present invention to provide such a piston, wherein the effectiveness of the cooling provided by the flow of lubricant in said space in the piston crown portion is enhanced.

It is a further object of the present invention to provide such a piston, whose mechanical strength is improved.

It is a further object of the present invention to provide such a piston, in the use of which undue thermal stress is not caused to the outer peripheral parts thereof or to the piston rings mounted thereon.

It is a further object of the present invention to provide such a piston, wherein the cooling flow of lubricant in said space within the piston crown portion is caused to have a definite direction.

It is a yet further object of the present invention to provide such a piston, which is durable and reliable during use.

It is a yet further object of the present invention to provide such a piston, which can be made in one operation by casting.

It is a yet further object of the present invention to provide such a piston, which is easy to manufacture.

It is a yet further object of the present invention to provide such a piston, which does not cost a great deal to manufacture.

According to the most general aspect of the present invention, these and other objects are accomplished by a piston for an internal combustion engine, comprising a crown portion and a generally hollow cylindrical side wall portion joining thereto to define a generally cup shaped structure having a piston inside space therein, said crown portion being formed with a hollow space therein for circulating lubricant therethrough thereby to cool said crown portion, said hollow space extending over a substantial portion of a transverse cross section of said crown portion, thereby leaving a transverse wall portion which separates said hollow space from said piston inside space; said crown portion further comprising a plurality of integrally formed ribs extending generally in an axial direction of said piston and in radial directions thereof, so as axially to traverse radially outside portions of said hollow space; said transverse wall portion being formed with at least one lubricant inlet opening and at least one lubricant outlet opening.

According to such a structure, because the ribs are provided as extending generally in the radial direction of the hollow space and in its axial direction, i.e. not substantially lying across said radial direction at all, therefore they do not hinder a generally radial flow of lubricant which is adhering to and flowing across the surfaces of the hollow space for cooling the piston crown portion. And, because the lubricant flows in the radial direction, not only along the axially end surfaces of the hollow space, but also along the side surfaces of the ribs, the conduction of heat from the surfaces of the ribs to said lubricant is extremely effective for aiding the cooling of the piston crown as a whole, since by the provision of the ribs the effective total heat dissipation area of the interior of the hollow space is greatly increased, although the actual area of the ceiling surface thereof by itself is somewhat reduced. Further, by the provision of the ribs, the piston crown portion is made to be stronger by their reinforcing action, and accordingly, it is possible to make the hollow space much larger, especially in its radial direction, and the side wall intervening between it and the outer peripheral surface of the piston correspondingly thinner, than would be possible if no such ribs were provided; in this way, also, the cooling effectiveness of the lubricant flow in the hollow space is improved. Yet further, the ribs also serve the very important function of providing a good path for heat conduction between the upper part of the piston crown which is exposed to the heat within the combustion chamber and the lower part of the piston, which means that this heat flow is kept from being concentrated in the side wall portion of the piston mentioned above, in or near which typically the piston rings are located; and accordingly thermal fatigue of this portion of the piston, and associated damage to the piston rings, is avoided.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

Figure 1:
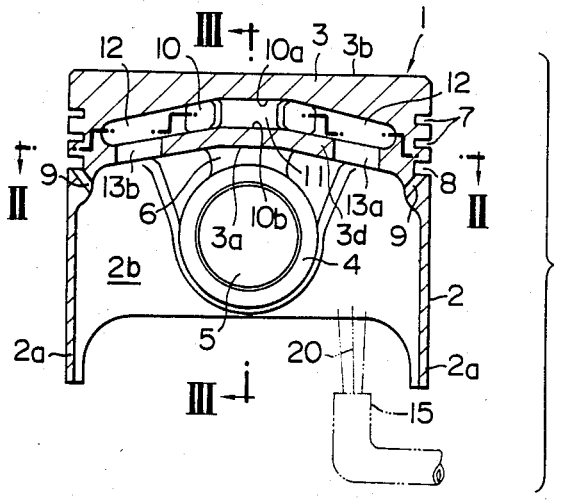
FIG. 1 is a longitudinal sectional view of a first preferred embodiment of the piston for an internal combustion engine according to the present invention, in which a dividing wall between the cavity within said piston and an internal cooling space defined within the crown thereof is formed with one lubricant injection hole and three lubricant drain holes pierced therethrough, and in which four fins are formed within said internal cooling space, the view being taken in two planes, each of which contains one of the central longitudinal axes of two of said lubricant holes, said planes intersecting in a line coinciding with the central longitudinal axis of the piston the angle between the planes being bisected by the central longitudinal axis of a piston pin fitting hole formed in the piston.
Figure 2:
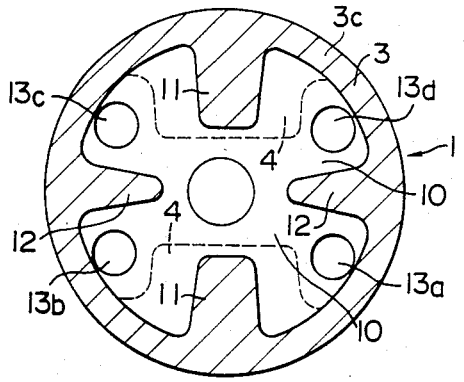
FIG. 2 is a transverse sectional view of said first preferred embodiment, taken in planes indicated by the broken line between the arrows II—II in FIG. 1 and perpendicular to said central axis of said piston.
Figure 3:
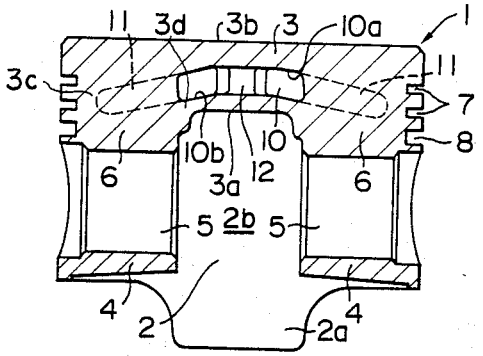
FIG. 3 is another longitudinal sectional view of said first preferred embodiment, taken in a plane shown by the arrows III—III in FIG. 1 and containing said central axis of said piston and also containing said central axis of said piston pin fitting hole.

The present invention will now be described with reference to the preferred embodiments thereof, and with reference to the appended drawings. FIGS. 1 and 3 show the first preferred embodiment in mutually perpendicular longitudinal sectional views, while FIG. 2 is a transverse sectional view. The piston according to this first preferred embodiment, generally denoted by the reference numeral 1, is made by casting, and is formed generally as a cup shaped body containing a cavity 2*b*, and having: a cylindrical side wall portion 2 from which there extend two skirt portions 2*a*, a top wall or crown portion 3, and two boss portions 4. The boss portions 4 are each pierced with a piston pin fitting hole 5, and lie just below the crown portion 3 as seen in FIGS. 1 and 2, confronting one another on opposite sides of the central axis of the piston; and their inner ends protrude towards one another. Their piston pin fitting holes 5 are mutually coaxial, and are adapted to together receive a piston pin, not shown in the figures, for pivotably fitting the piston 1 to a connecting rod, also not shown. Between the upper surface in FIGS. 1 and 3 of each of the boss portions 4 and the opposing part of the lower face 3*a* of the piston crown portion 3 there extends a rib 6, for reinforcement of the boss portions 4 by integrally connecting them to the piston crown portion 3; these so called pin boss ribs 6 are a per se well known feature currently used in conventional pistons. Circumferentially around the outer surface of the crown portion 3 there are incised two piston ring grooves 7 and an oil scraper ring groove 8, and, as shown in FIG. 1, the bottom of said scraper ring groove 8 is communicated to the internal cavity 2*b* within the piston by a plurality of oil return holes 9.

Within the crown portion 3 of the piston 1 there is defined an internal space 10 for circulation of lubricant for cooling said piston crown as will be explained later, this space 10 being formed during the casting process of the piston by using a sand core. The wall portion separating the space 10 from the piston cavity 2*b* is designated in the figures by the reference numeral 3*d*. This cooling space 10, of which a transverse section can be seen in FIG. 2, is generally circularly symmetric, and extends substantially completely across the piston crown portion 3, with only a fairly narrow wall portion 3*c* being left between the outer edge of said space 10 and the outer cylindrical surface of the piston 3. The space 10 is defined by a ceiling surface 10*a* on its upper side as seen in FIGS. 1 and 3, i.e. on the side of the upper face 3*b* of the piston crown portion 3, and by a floor surface 10*b* on its lower side as seen in those figures, i.e. on the side of the lower face 3*a* of the piston crown portion 3; so that these surfaces 10*a* and 10*b* oppose one another along the axial direction of the piston 1. Each of these surfaces 10*a* and 10*b* is formed generally as an obtuse angled cone with its point oriented upwards as seen in the figures, i.e. pointing towards the upper face 3*b* of the piston crown 3. Thus, the cooling space 10 is also generally formed as an obtuse angled hollow cone, inclined towards its center in the upwards direction.

Within the cooling space 10 there are provided, in this first preferred embodiment, two ribs or fins 11 on opposite sides of the central axis of the piston 1 and aligned with and corresponding in their angular positions around said central axis to the pin boss ribs 6 which extend axially between the bosses 4 and the under surface 3*a* of the piston crown 3, and there are further provided two other ribs or fins 12 also on opposite sides of the central axis of the piston 1 and located between the ribs 11 as 90° displaced therefrom with respect to their angular positions around said central axis and aligned with the piston skirts 2*a*. These ribs 11 and 12 are formed by casting during the casting process of the piston 1 as a whole. Each of these ribs 11 and 12 extends in the axial direction from the ceiling surface 10*a* to the floor surface 10*b* of the cooling space 10, and joins these surfaces together in a reinforcing and heat transmitting manner. In the radial direction, each of these ribs 11 and 12 extends outwards to join the inner wall surface of the wall portion 3*c*, of said piston, and inwards to a point quite near the central axis of the piston 1 but not on it.

The wall portion 3*d* is pierced, in this first preferred embodiment, by four through holes 13*a*, 13*b*, 13*c*, and 13*d*, which thus extend from the under surface 3*a* of the piston crown 3 to the floor surface 10*b* of the space 10, and communicate the cooling space 10 to the piston cavity 2*b*. These holes 13*a* through 13*d* are used for removing the sand core from within the space 10 after casting the piston, and also the hole 13*a* serves, as will be seen later, as a lubricant injection hole, while the three holes 13*b*, 13*c*, and 13*d* serve as lubricant drain holes. The holes 13*a* and 13*c* are situated 180° apart, lying on opposite sides of the central axis of the piston 1, and similarly so are the holes 13*b* and 13*d*. Thus, in this first preferred embodiment, each of the spaces between each pair of neighboring ribs 11, 12 is communicated to the piston cavity 2*b* via one of the holes 13*a* through 13*d*.

The oil return holes 9 lead from the bottom of the scraper ring groove 8 diagonally inwards and downwards directly to the cavity 2*b* within the piston, thus bypassing the cooling space 10 and not opening thereto.

Now the cooling of this piston 1 by the flow of engine lubricant, as promoted by this construction, during operation of the internal combustion engine to which said piston 1 is fitted, will be explained.

As the piston 1 reciprocates up and down (in the sense of FIGS. 1 and 2) in its cylinder bore (not shown) at high speed, a jet 20 of engine lubricant is squirted upwards as it from a nozzle 15 which is secured to some fixed engine part, not shown, such as the crankcase. This jet 20 is so aimed as to pass largely through the wall portion 3*d* via the the above mentioned lubricant injection hole 13*a*, so as largely to pass into the cooling space 10 and to hit against the ceiling surface 1O*a* of said cooling space 10. Now, when the piston 1 is moving upwards in FIGS. 1 and 2 away from the nozzle 15, i.e. on its compression or its exhaust stroke, then the speed of the lubricant jet 20 relative to the ceiling surface 1O*a* of the space 10 is not so very great, so that this jet 20 does not hit the ceiling surface 1O*a* very hard and does not splash all over it and wet it very effectively (although by doing so to some extent some cooling is provided therefor at this time), but instead, while some of this lubricant adheres to the ceiling surface 10*a* as a lubricant film, most of the lubricant in the jet 20 falls down against the floor surface 10*b* of the space 10, so as to flow into the spaces between the ribs 11 and 12. Most of this lubricant then flows out through the lubricant drain holes 13*b* through 13*d*, but a further amount of it remains within the space 10 as another lubricant film on the floor surface 10*b* thereof. Thus, as the piston 1 comes up to its top dead center, lubricant films are formed both on the ceiling surface 10*a* and the floor surface 10*b* of the cooling space 10.

As the piston 1 goes over its top dead center and starts downwards in the figures on its power or its intake stroke, then due to its sudden reversal of direction of motion this lubricant film on the floor surface 10*b* is hurled upwards by the action of its inertia and is thrown against the ceiling surface 10*a*. Since the ceiling surface 10*a* is, as explained above, shaped as a concave cone, this lubricant all flows (along with the lubricant film which was all the while adhering to said ceiling surface 10*a*) towards the central portion of said ceiling surface 10*a* so as to accumulate in a central pool thereon, and during this flowing action of course the lubricant provides the required cooling action for the piston crown 3. Meanwhile, during this downward stroke of the piston 1, also the jet 20 of lubricant from the nozzle 15 continues to pass through the lubricant injection hole 13*a*, and, since now the speed of the lubricant jet 20 relative to the piston 1 is great, now this jet 20 hits the ceiling surface 10*a* of the space 10 quite hard at a point substantially directly above the hole 13*a*. The lubricant from the jet 20 then flows along the ceiling surface 10*a*, and also particularly along the ribs 11 and 12, thus cooling them, away from its impact point and towards the central part of the surface 10*a* (this being aided by the conical shape of the surface 10*a*), and this flow of lubricant from the jet 20 mixes with the other above described flow of the lubricant splashed up from the floor surface 10*b*. When the piston 1 approaches its bottom dead center and starts to be accelerated in the upwards direction in the figures, then this lubricant accumulated generally in the central part of the ceiling surface 10*a* becomes detached from said ceiling surface 10*a*, again by the action of its inertia, and falls downwards towards the three lubricant drain holes 13*b* through 13*d* to be drained therethrough. Of course, quite a lot of this lubricant is again entrained into the films of lubricant on the floor surface 10*b*, to go again through the cycle described above; but as a net result there is ensured a substantial and steady flow of lubricant in the space 10 across its ceiling surface 10*a* to cool the piston crown 3, along the surface 10*a* from the general area thereof opposed to the lubricant injection hole 13*a* to the general area thereof opposed to the lubricant drain holes 13*b* through 13*d*, via the central or point area of said ceiling surface 10*a*. And generally the flow of lubricant is through the injection hole 13*a* across the ceiling surface 10*a* while perhaps once or repeatedly entering the film of lubricant on the floor surface 13*b*, and then out through one of the drain holes 13*b* through 13*d*. Also, of course quite a lot of this lubricant which has passed through the drain holes 13*b* through 13*d*falls down onto the tops of the piston pin bosses 4, possibly via flowing down along the pin boss ribs 6, and flows around these bosses to their lower surfaces.

Because the ribs 11 and 12 are provided as extending generally in the radial direction of the space 10 and in its axial direction, and do not lie substantially across said radial direction at all, they do not hinder the above described generally radial flow of cooling lubricant which is adhering to and flowing across the ceiling surface 10*a*. This is also ensured by the fact that the ribs 11 and 12 do not extend inwards right up to the central axis of the piston 1 (which would cause them to meet one another), but terminate short thereof. And, because the lubricant flows in the radial direction, not only along the ceiling surface 10*a* and the floor surface 10*b*, but also along the side surfaces of the ribs 11 and 12, the conduction of heat from the surfaces of the ribs 11 and 12 to said lubricant flowing radially therealong is extremely effective for aiding the cooling of the piston crown 3 as a whole, since by the provision of the ribs 11, 12 the effective total heat dissipation area of the interior of the cooling space 10 is greatly increased, although of course the actual area of the ceiling surface itself 10*a* is somewhat reduced. Further, by the provision of the ribs 11 and 12, the piston crown 3 is made to be stronger by the reinforcing action of the ribs, and accordingly it is possible to make the cooling space 10 much larger, and the side wall 3*c* thinner, than would be possible if no such ribs 11 and 12 were provided; in this way, also, the cooling effectiveness of lubricant flow in the space 10 is improved. Further, the ribs 11 and 12 also serve the very important function of providing a good path for heat conduction between the upper part of the piston crown 3 which is exposed to the heat of the flaming gases within the combustion chamber and the wall portion 3*d*. This means that this heat flow is kept from being concentrated in the side wall 3*c*, and accordingly thermal fatigue of this portion of the piston, and associated damage to the piston rings 7 and 8, is avoided.

Figure 4:
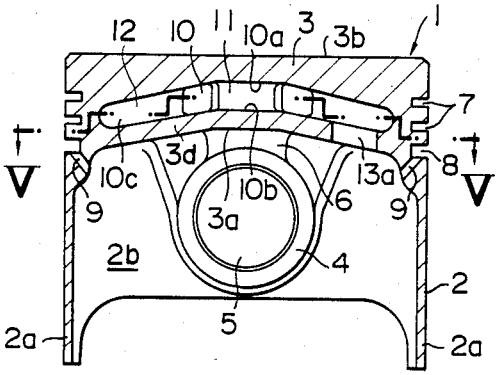
FIG. 4 is a longitudinal sectional view, similar to FIG. 1, of a second preferred embodiment of the piston according to the present invention, in which only one lubricant injection hole and one lubricant drain hole are pierced through said dividing wall, and in which again four fins are formed within said internal cooling space, the view being taken in intersecting planes corresponding to the planes of FIG. 1 with respect to the first preferred embodiment.
Figure 5:
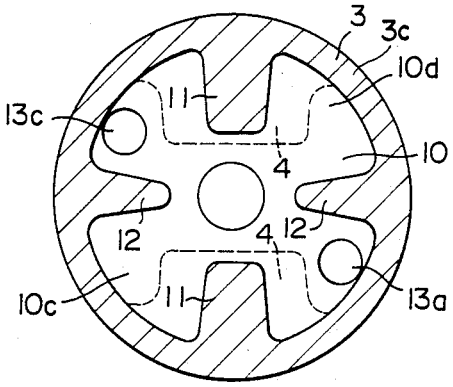
FIG. 5 is a transverse sectional view, similar to FIG. 2, of said second preferred embodiment of the piston according to the present invention, taken in planes as indicated by the broken line between arrows V—V in FIG. 4.

In FIGS. 4 and 5, there is shown in sectional view a second preferred embodiment of the piston according to the present invention, in fashions similar to FIGS. 1 and 2 respectively; and like parts in this second embodiment to parts in the first embodiment are denoted by like numerals. In this second preferred embodiment, the lubricant drain holes 13*b* and 13*d* are omitted, so that only one lubricant drain hole 13*c* is provided, on the other side of the central axis of the piston 1 from the lubricant injection hole 13*a*. Apart from this point, the construction of this second embodiment is quite the same as that of the first preferred embodiment described above.

The effect of this feature is that the two spaces between ribs 11 and 12 which are denoted by 10*c* and 10*d* in FIG. 5 and which do not have any holes through the wall portion 3*d* opening to them serve as lubricant reservoirs, since the floor surface 10*b* is inclined downwards as seen in FIG. 4 from its radially inside portion to its radially outside portion, thus defining lubricant pool receiving spaces. In this case, as the piston 1 moves upwards towards its top dead center and as lubricant is squirted in as the jet flow 20 through the lubricant injection hole 13*a*, then much of this lubricant is accumulated in the spaces 10*d*, and then as the piston 1 passes its top dead center and is accelerated downwards these accumulations of lubricant are violently splashed upwards against the ceiling surface 10*a* and flow radially inwardly therealong, thus again accentuating the cooling lubricant flow pattern described above with respect to the first preferred embodiment by increasing the volume of said lubricant. Thereby, the cooling of the piston crown portion 3 is even more effectively accomplished.

Figure 6:
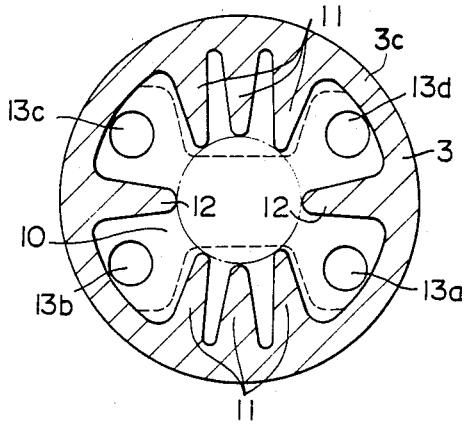
FIG. 6 is a transverse sectional view, similar to FIGS. 2 and 5, of a third preferred embodiment of the piston according to the present invention, in which this time said internal cooling space is formed with eight ribs, taken in planes corresponding to the planes of FIGS. 2 and 5 with respect to the first and second preferred embodiments.

In FIG. 6, there is shown in sectional view a third preferred embodiment of the piston according to the present invention, in a fashion similar to FIGS. 2 and 5; and like parts in this third embodiment to parts in the first and second embodiments are again denoted by like numerals. In this third preferred embodiment, as in the first embodiment, three lubricant drain holes 13*b* through 13*d* are provided; but each of the two ribs 11 of the first embodiment is now provided as a set of three relatively thin fins 11 lying close together, all these six fins 11 again extending in the radial direction of the cooling space 10. Apart from this point, the construction of this third embodiment is quite the same as that of the first preferred embodiment described above. The effect of this feature is that the cooling of the piston crown portion 3 is even more effectively accomplished; however, because of the fine detail inherent in the structure of the fins 11, the casting process for the space 10 is made slightly more difficult.

Figure 7:
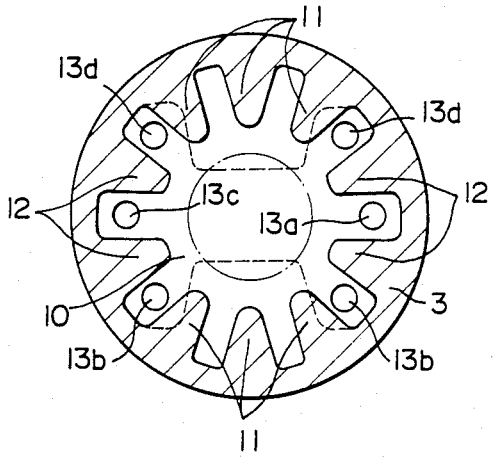
FIG. 7 is a transverse sectional view, similar to FIGS. 2, 5, and 6, of a fourth preferred embodiment of the piston according to the present invention, in which this time one lubricant injection hole and five lubricant drain holes are pierced through said dividing wall, and in which said internal cooling space is formed with ten ribs, taken in planes corresponding to the planes of FIGS. 2, 5, and 6 with respect to the first, second, and third preferred embodiments.

In FIG. 7 there is shown in sectional view a fourth preferred embodiment of the piston according to the present invention, in a fashion similar to FIGS. 2, 5, and 6; and like parts in this fourth embodiment to parts in the first through third embodiments are again denoted by like numerals. In this fourth preferred embodiment, altogether ten ribs 11 and 12 are provided, these ten ribs 11, 12 again extending in the radial direction of the cooling space 10 and being substantially equally spaced apart, and now all being fairly thick and robust. Also five lubricant drain holes 13*b*, 13*c*, and 13*d* are provided. Apart from these points, the construction of this fourth embodiment is the same as that of the first preferred embodiment described above. The effect of this feature is that the cooling of the piston crown portion 3 is again very effectively accomplished, by increase of the number of the ribs 11 and 12, without making the fabrication process of the piston 1 substantially more difficult.

Although the present invention has been shown and described with reference to a number of preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A piston for an internal combustion engine, comprising a crown portion having an axial outer end surface to be exposed to combustion gases and a generally hollow cylindrical side wall portion joining thereto to define a generally cup shaped structure having a piston inside space therein, said crown portion being formed with a hollow space therein for circulating lubricant therethrough thereby to cool said crown portion, said hollow space extending over a substantial portion of a transverse cross section of said crown portion and being defined by a first wall surface of a generally shallow concave conical shape on one axial side thereof closer to said axial outer end surface of said crown portion, thereby leaving a transverse wall portion which separates said hollow space from said piston inside space;

said crown portion further comprising a plurality of integrally formed ribs extending generally in an axial direction of said piston and in radial directions thereof, so as axially to transverse radially outside portions of said hollow space; said transverse wall portion being formed with at least one lubricant inlet opening and at least one lubricant outlet opening.

2. A piston according to claim 1, wherein a second wall surface which defines said hollow space on the axial side opposing said first wall surface is formed in a generally shallow convex conical shape.

3. A piston according to claim 1, wherein said lubricant inlet and outlet openings open between said ribs.

4. A piston according to claim 3, wherein the number of spaces defined between said ribs in said hollow space is larger than the number of the sum of said lubricant inlet and outlet openings.

5. A piston according to claim 1, wherein said first wall surface is more precisely of a shallow concave truncated conical shape, and said ribs are joined with only conical portions of said truncated conical shape.

6. A piston for an internal combustion engine, comprising a crown portion having an axial outer end surface to be exposed to combustion gases, a generally hollow cylindrical side wall portion joining thereto to define a generally cup shaped structure having a piston inside space therein, a pair of piston pin bosses formed in said generally hollow cylindrical side wall portion, and a pair of pin boss ribs which extend generally in the axial direction of the piston and join said bosses to said piston crown portion, said crown portion being formed with a hollow space therein for circulating lubricant therethrough thereby to cool said crown portion, said hollow space extending over a substantial portion of a transverse cross section of said crown portion, thereby leaving a transverse wall portion which separates said hollow space from said piston inside space;

said crown portion further comprising a plurality of integrally formed ribs extending generally in an axial direction of said piston and in radial directions thereof, so as axially to traverse radially outside portions of said hollow space; said transverse wall portion being formed with at least one lubricant inlet opening and at least one lubricant outlet opening; and each of said pin boss ribs being aligned, with respect to orientation about a central axis of said piston, in substantial correspondence with at least one of said ribs in said hollow space.

7. A piston according to claim 6 wherein each of said pin boss ribs in aligned, with respect to orientation about the central axis of said piston, in substantial correspondence with a plurality of said ribs in said hollow space.

8. A piston according to claim 6, wherein said hollow space is defined by a first wall surface of a shallow concave truncated conical shape on one axial side thereof closer to said axial outer end surface of said crown portion, and said ribs in said crown portion are joined with only conical portions of said truncated conical shape.

* * * * *

UNITED STATES PATENT AND TRADEMARK OFFICE

CERTIFICATE OF CORRECTION

PATENT NO. : 4,530,312

DATED : July 23, 1985

INVENTOR(S) : M. Kanda et al.

It is certified that error appears in the above-identified patent and that said Letters Patent is hereby corrected as shown below:

Column 3, line 9, after "thinner" omit the comma.

Column 3, line 20, after "accordingly" add a comma.

Column 3, line 50, after "piston" add a comma.

Column 5, line 37, after "3c" omit the comma.

Column 5, line 68, change "as it" to --at it--.

Column 6, line 5, change "surface 10a" to --surface 10a".

Column 6, line 10, change "face 10a" to --face 10a--.

Column 6, line 11, change "surface 10a" to --surface 10a--.

Column 6, line 13, after "extent" add a comma.

Column 6, line 37, change "action of course" to --action, of course,--.

Column 6, line 51, change "above de-" to --above-de---.

UNITED STATES PATENT AND TRADEMARK OFFICE

CERTIFICATE OF CORRECTION

PATENT NO. : 4,530,312

DATED : July 23, 1985

INVENTOR(S) : M. Kanda et al.

It is certified that error appears in the above-identified patent and that said Letters Patent is hereby corrected as shown below:

Column 7, line 3, after "13a" add a comma.

Column 7, line 7, after "course" add a comma.

Column 7, line 8, change "13dfalls" to --13d falls--.

Column 7, line 45, after "accordingly" add a comma.

Column 8, line 5, after "downwards" add a comma.

Column 8, line 42, after "Also" add a comma.

Column 10, line 27, change "in aligned," to --is aligned,--.

Column 10, line 34, after "thereof" add a comma.

Signed and Sealed this

*Thirty-first* Day of *December 1985*

[SEAL]

*Attest:*

DONALD J. QUIGG

*Attesting Officer*

*Commissioner of Patents and Trademarks*